US008708331B2

(12) United States Patent
Ueyama

(10) Patent No.: US 8,708,331 B2
(45) Date of Patent: Apr. 29, 2014

(54) SHEET SUPPLYING APPARATUS

(71) Applicant: Junki Ueyama, Nagoya (JP)

(72) Inventor: Junki Ueyama, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/836,915

(22) Filed: Mar. 15, 2013

(65) Prior Publication Data

US 2013/0256979 A1 Oct. 3, 2013

(30) Foreign Application Priority Data

Mar. 30, 2012 (JP) ..... 2012-080571

(51) Int. Cl.
*B65H 1/08* (2006.01)

(52) U.S. Cl.
USPC ..... 271/127; 271/126

(58) Field of Classification Search
USPC ..... 271/126, 127, 109
See application file for complete search history.

(56) References Cited

U.S. PATENT DOCUMENTS

| | | | | |
|---|---|---|---|---|
| 5,895,038 | A * | 4/1999 | Takashima | 271/114 |
| 6,000,689 | A * | 12/1999 | Furuki et al. | 271/10.11 |
| 6,550,759 | B2 * | 4/2003 | Kotaka et al. | 271/10.11 |
| 7,270,323 | B2 * | 9/2007 | Somemiya | 271/127 |
| 7,494,120 | B2 * | 2/2009 | Shimizu et al. | 271/152 |
| 7,594,649 | B2 * | 9/2009 | Liu et al. | 271/116 |
| 8,588,673 | B2 * | 11/2013 | Hayakawa et al. | 399/393 |
| 2001/0028141 | A1 * | 10/2001 | Kotaka et al. | 271/10.11 |
| 2006/0071402 | A1 * | 4/2006 | Takasaka et al. | 271/126 |
| 2006/0157914 | A1 * | 7/2006 | Suwa | 271/126 |
| 2006/0180986 | A1 * | 8/2006 | Hattori | 271/110 |
| 2007/0001376 | A1 * | 1/2007 | Lim et al. | 271/121 |
| 2012/0235347 | A1 * | 9/2012 | Takiguchi | 271/109 |
| 2013/0207337 | A1 * | 8/2013 | Tokisawa et al. | 271/126 |

FOREIGN PATENT DOCUMENTS

| | | | | |
|---|---|---|---|---|
| GB | 2121769 | A * | 1/1984 | B65H 5/06 |
| JP | 62-008245 | | 1/1987 | |
| JP | 63-001822 | | 1/1988 | |
| JP | 02-120436 | | 9/1990 | |
| JP | 02-120436 | U | 9/1990 | |
| JP | 10-120197 | A | 5/1998 | |
| JP | 2004-168498 | A | 6/2004 | |
| JP | 2007-176696 | A | 7/2007 | |

OTHER PUBLICATIONS

Co Pending U.S. Appl. No. 13/836,571, filed Mar. 15, 2013.

* cited by examiner

*Primary Examiner* — Jeremy R Severson
(74) *Attorney, Agent, or Firm* — Banner & Witcoff, Ltd.

(57) ABSTRACT

A sheet supplying apparatus includes a feed roller, a sheet receiving plate, a lifting member, an urging member, and a cam. The sheet receiving plate is configured to pivot between a nearby position where the sheet receiving plate is disposed near the feed roller and a remote position where the sheet receiving plate is disposed remote from the feed roller. The lifting member is configured to pivot between a first position where the sheet receiving plate is in the nearby position and a second position where the sheet receiving plate is in the remote position. The urging member is configured to urge the lifting member from the second position toward the first position. The cam is configured to contact and move the lifting member from the second position to the first position when the feed roller feeds a sheet, and to move the lifting member to the second position again.

7 Claims, 11 Drawing Sheets

Fig.6A
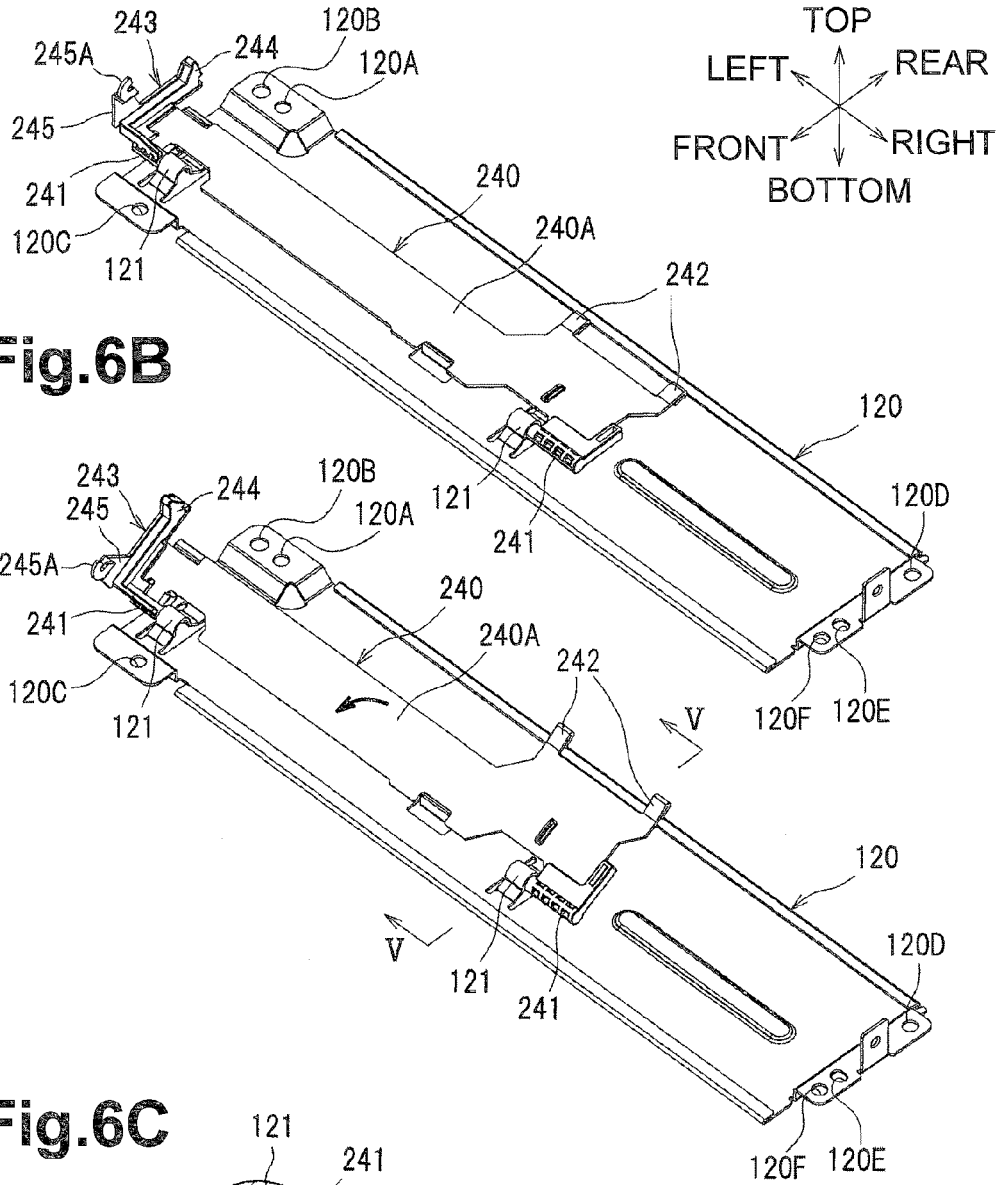
Fig.6B
Fig.6C
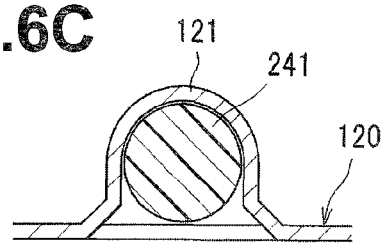

Fig.7A
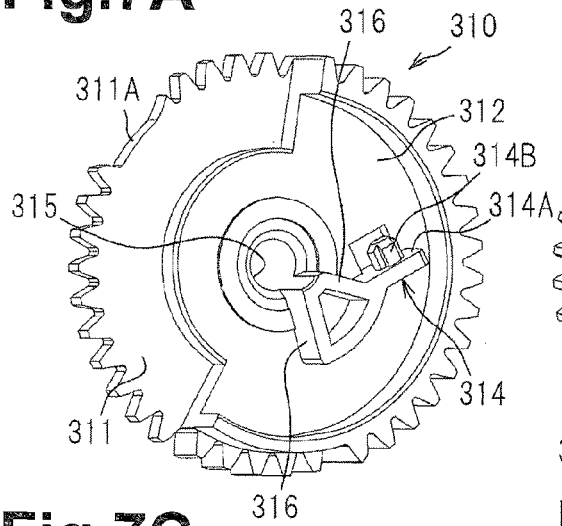
Fig.7B
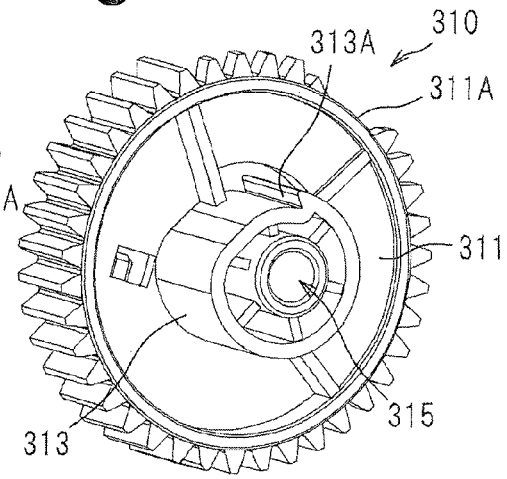
Fig.7C
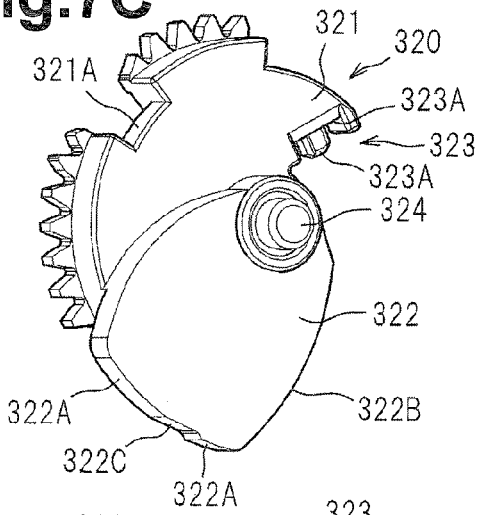
Fig.7D
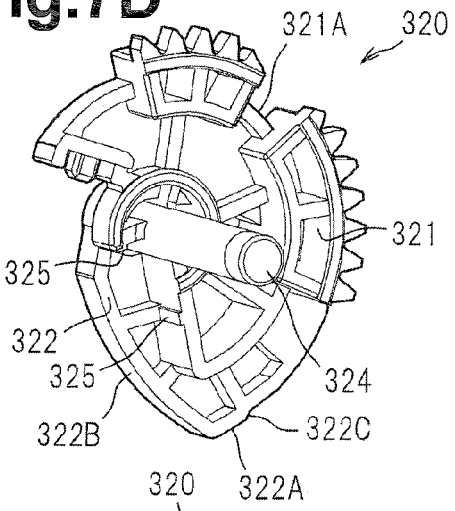
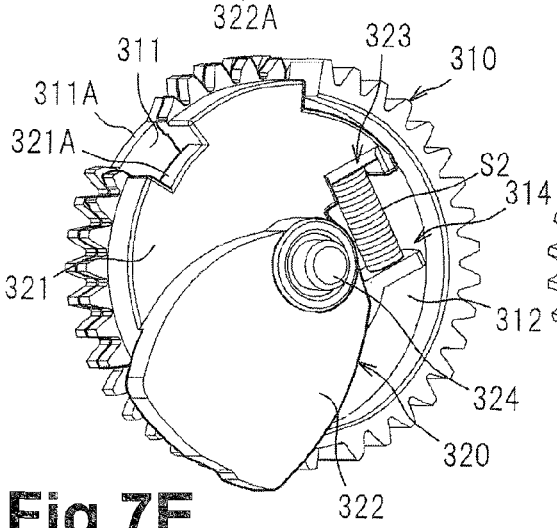
Fig.7E
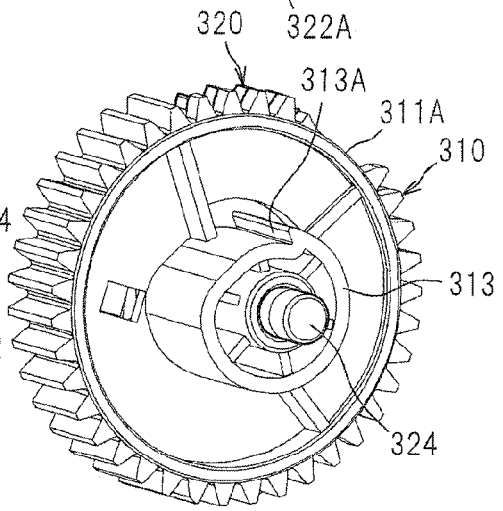
Fig.7F

SHEET SUPPLYING APPARATUS

CROSS REFERENCE TO RELATED APPLICATION

This application claims priority from Japanese Patent Application No. 2012-080571 filed on Mar. 30, 2012, which is incorporated herein by reference in its entirety.

FIELD

Aspects of the disclosure relate to a sheet supplying apparatus including a feed roller and a sheet receiving plate configured to receive a recording sheet.

BACKGROUND

A known sheet supplying apparatus, which is disposed within an image forming apparatus, includes a feed roller, a sheet receiving plate configured to receive a recording sheet, urging members, and cams. The sheet receiving plate is disposed such that one end portion thereof is located under the feed roller and the other end portion thereof is rotatably supported by a main body. With this structure, the sheet receiving plate is configured to move between a nearby position where one end portion moves toward the feed roller and a remote position where the other end portion moves away from the feed roller. The urging members are disposed under the sheet receiving plate and urge one end portion of the sheet receiving plate from the remote position toward the nearby position. The cams are configured to rotate such as to contact or separate from the sheet receiving plate. When the cams are in contact with the sheet receiving plate, the cams are configured to position the sheet receiving plate in the remote position against urging forces of the urging members.

SUMMARY

However, in the above art, the cams are structured to directly contact the sheet receiving plate, and thus the sheet receiving plate is subjected to direct load from the cams. Although there is need to increase rigidity of the sheet receiving plate, the physical size of the sheet receiving plate cannot be reduced because the sheet receiving plate is configured to receive a recording sheet. Making the sheet receiving plate with a material having high rigidity, cost may be increased.

Illustrative aspects of the disclosure provide a sheet supplying of which a sheet receiving plate does not need high rigidity.

According to an aspect of the disclosure, a sheet supplying apparatus includes a feed roller, a sheet receiving plate, a lifting member, an urging member, and a cam. The feed roller is configured to feed a recording sheet. The sheet receiving plate is configured to receive the recording sheet on a sheet receiving surface and pivot between a nearby position where the sheet receiving plate is disposed near the feed roller and a remote position where the sheet receiving plate is disposed remote from the feed roller. The lifting member is disposed on a side of the sheet receiving plate opposite to the sheet receiving surface and configured to pivot between a first position where the sheet receiving plate is in the nearby position and a second position where the sheet receiving plate is in the remote position. The urging member is configured to urge the lifting member from the second position toward the first position. The cam is configured to contact the lifting member and, when the feed roller feeds a recording sheet, cause the lifting member to move from the second position to the first position then back to the second position again. The lifting member includes a contact portion configured to contact the cam. The cam has a first surface and a second surface, and the cam is configured to, when the first surface faces the contact portion of the lifting member, position the lifting member in the second position against an urging force of the urging member, and configured to, when the second surface faces the contact portion of the lifting member, allow the lifting member to move from the second position to the first position.

BRIEF DESCRIPTION OF THE DRAWINGS

Illustrative aspects will be described in detail with reference to the following figures in which like elements are labeled with like numbers and in which:

FIGS. 6A, 6B, and 6C illustrate the bridging member and a lifting member, wherein FIG. 6A is a perspective view illustrating the lifting member in a second position, FIG. 6B is a perspective view illustrating the lifting member in a first position, and FIG. 6C is a sectional view taken along a line V-V illustrating a rotational shaft and a support portion;

FIG. 7A is a perspective view of a first gear;

FIG. 7B is a perspective view of an opposite side of the first gear from that shown in FIG. 7A;

FIG. 7C is a perspective view of a second gear;

FIG. 7D is a perspective view of an opposite side of the second gear from that shown in FIG. 7C;

FIG. 7E is a perspective view of the first gear and the second gear;

FIG. 7F is a perspective view of an opposite side of the first gear and the second gear from that shown in FIG. 7E;

DETAILED DESCRIPTION

A first illustrative embodiment will be described in detail with reference to the accompanying drawings. In the following description, a general structure of a laser printer including a feeder portion as an example of a sheet feeding apparatus will be described and then features of the disclosure will be described in detail.

In the following description, orientations or sides of the laser printer will be identified based on the laser printer disposed in an orientation in which it is intended to be used. In other words, in FIG. 1, the left side is referred to as the front or front side, the right side is referred to as the rear or the rear side, the up side is referred to as the top or upper side, and the down side is referred to as the bottom or lower side. The top-bottom direction may be referred to as a vertical direction.

Figure 1:
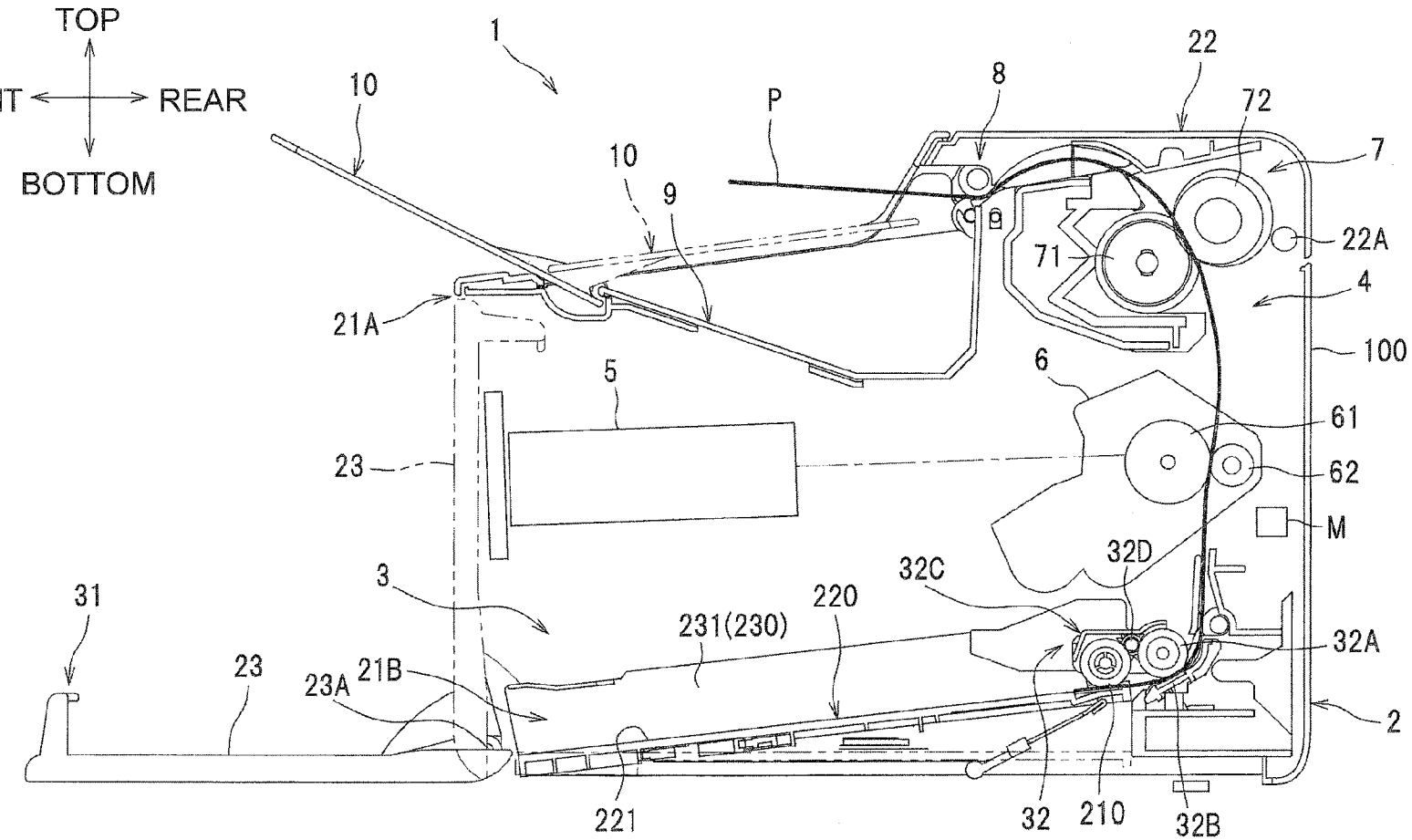
FIG. 1 illustrates a general structure of an illustrative image forming apparatus, e.g. a laser printer, according to an embodiment of the disclosure.

As shown in FIG. 1, the laser printer 1 includes a main body 2, a feeder portion 3 for feeding a sheet P as an example of a recording sheet, and an image forming portion 4 for forming an image on the sheet P.

The main body 2 includes a casing 100, a top cover 22, and a front cover 23. The casing 100 has an opening 21A for attaching and removing a process cartridge 6 in an upper portion, and an insertion opening 21B for inserting sheets P in a front portion.

The top cover 22 is configured to pivot upward about a pivot 22A of the top cover 22 disposed in an upper rear portion of the main body 2. The top cover 22 covers from a rear end portion of the main body 2 to a front end portion thereof, and pivots upward such that an upper side of the main body 2 is released.

The front cover 23 is configured to pivot frontward about a pivot 23A of the front cover 23 disposed in a lower front portion of the main body 2. The front cover 23 covers from a lower end portion of the main body 2 to an upper end portion thereof, and pivots frontward such that a front side of the main body 2 is released. In FIG. 1, the front cover 23 closing the front side of the main body 2 is indicated by a double dotted line, and the front cover 23 releasing the front side of the main body 2 is indicated by a solid line.

In other words, the opening 21A in the upper portion of the casing 100 is opened and closed by the top cover 22, and the insertion opening 21B in the front portion is opened and closed by the front cover 23.

The feeder portion 3 is disposed in a lower portion of the main body 2, and includes a sheet tray 31 for placing a sheet P thereon and a sheet feed mechanism 32 that feeds a sheet P on the sheet tray 31 toward the image forming portion 4.

The sheet tray 31 includes the front cover 23 and a sheet receiving plate 220, as an example of a recording sheet receiving portion, which is disposed in a lower portion of the main body 2. Specifically, the front cover 23 is configured to pivot about a lower end portion thereof, and when tilted frontward, the front cover 23 constitutes a part of the sheet tray 31. The sheet receiving plate 220 is configured to, when the feed roller 210 feeds a sheet P, raise the sheet P received thereon toward a feed roller 210.

The sheet feed mechanism 32 includes the feed roller 210, a separation roller 32A, and a separation pad 32B. The feed roller 210 is disposed upstream of the separation roller 32A in a sheet conveying direction, and above the rear end of the sheet receiving plate 220. The separation roller 32A is disposed facing the separation pad 32B.

The feed roller 210 and the separation roller 32A constitute one part as a feed roller unit 32C. The feed roller unit 32C includes the feed roller 210, the separation roller 32A, and an idle gear 32D. The idle gear 32D engages a gear (not shown) that rotates together with the feed roller 210 and a gear (not shown) that rotates together with the separation roller 32A. Thus, the feed roller 210 and the separation roller 32A are configured to rotate in an interlocked manner.

In the feeder portion 3, the front cover 23 is tilted down frontward to form the sheet tray 31, and then a sheet P is placed on the sheet tray 31. The feed roller 210 rotates in contact with the sheet P placed on the sheet tray 31, and the sheet P placed on the sheet tray 31 is conveyed to the separation roller 32A, the sheet P is singly separated from the sheet tray 31 by the separation roller 32A and the separation pad 32B and conveyed to the image forming portion 4.

The image forming portion 4 includes a scanner unit 5, and a process cartridge 6, and a fixing unit 7.

The scanner unit 5 is disposed in a front portion of the main body 2, and includes a laser emitting portion, a polygon mirror, a lens, and a reflecting mirror, which are not shown. The scanner unit 5 irradiates a surface of a photosensitive drum 61 with a laser beam at high speed scanning.

The process cartridge 6 is located in a central portion at the rear side of the main body 2, and disposed above the sheet feed mechanism 32. The process cartridge 6 is detachable through the opening 21A from the casing 100 upward and frontward. The process cartridge 6 includes a transfer roller 62 that transfers a toner image formed on the photosensitive drum 61 to a sheet P, a charger, a developing roller, a layer thickness regulating blade, and a toner chamber, which are known and not shown.

In the process cartridge 6, the surface of the photosensitive drum 61, which is rotating, is uniformly charged by the charger, and then exposed with the laser beam from the scanner unit 5 by high speed scanning Thus, a potential in an exposed area lowers, and an electrostatic latent image based on image data is formed on the surface of the photosensitive drum 61.

The developing roller supplies toner in the toner chamber to the electrostatic latent image formed on the photosensitive drum 61, and a toner image is formed on the surface of the photosensitive drum 61. Then, when a sheet P passes between the photosensitive drum 61 and the transfer roller 62, the toner image carried on the surface of the photosensitive drum 61 is transferred onto the sheet P.

The fixing unit 7 is disposed in an upper rear side of the main body 2. The fixing unit 7 is located above the process cartridge 6 and includes a heat roller 71 and a pressure roller 72.

The heat roller 71 is a member that applies heat to a sheet P, and includes a heat source, e.g., a halogen lamp, which is not shown, inside.

The pressure roller 72 is a member that feeds a sheet P by sandwiching the sheet P with the heat roller 71, and is disposed diagonally upward from the rear side of the heat roller 71.

The fixing unit 7 structured as described above is configured to fix toner transferred onto the sheet P thermally while the sheet P passes between the heat roller 71 and the pressure roller 72. The sheet P having the toner thermally fixed thereon is conveyed to an ejection roller 8, which is disposed downstream of the fixing unit 7, and ejected from the ejection roller 8 to an ejection tray 9.

The ejection tray 9 extends diagonally upward from the rear side of the main body 2 to the front side, and is provided as a part of the top cover 22. An extension tray 10 is disposed frontward of the top cover 22 and at a front end portion of the ejection tray 9. The extension tray 10 has a pivot axis in the vicinity of the front end portion of the ejection tray 9, and is configured to pivot between a position facing the extension tray 9, which is indicated by a chain double-dashed line, and a position indicated by a solid line. When no image is formed, the extension tray 10 is folded to the position indicated by the chain double-dashed line to cover the ejection tray 9. When an image is formed, the extension tray 10 is unfolded to the position indicated by the solid line to hold a leading end of a sheet P to be ejected.

The following will describe the casing 100 constituting the main body 2.

Figure 2:
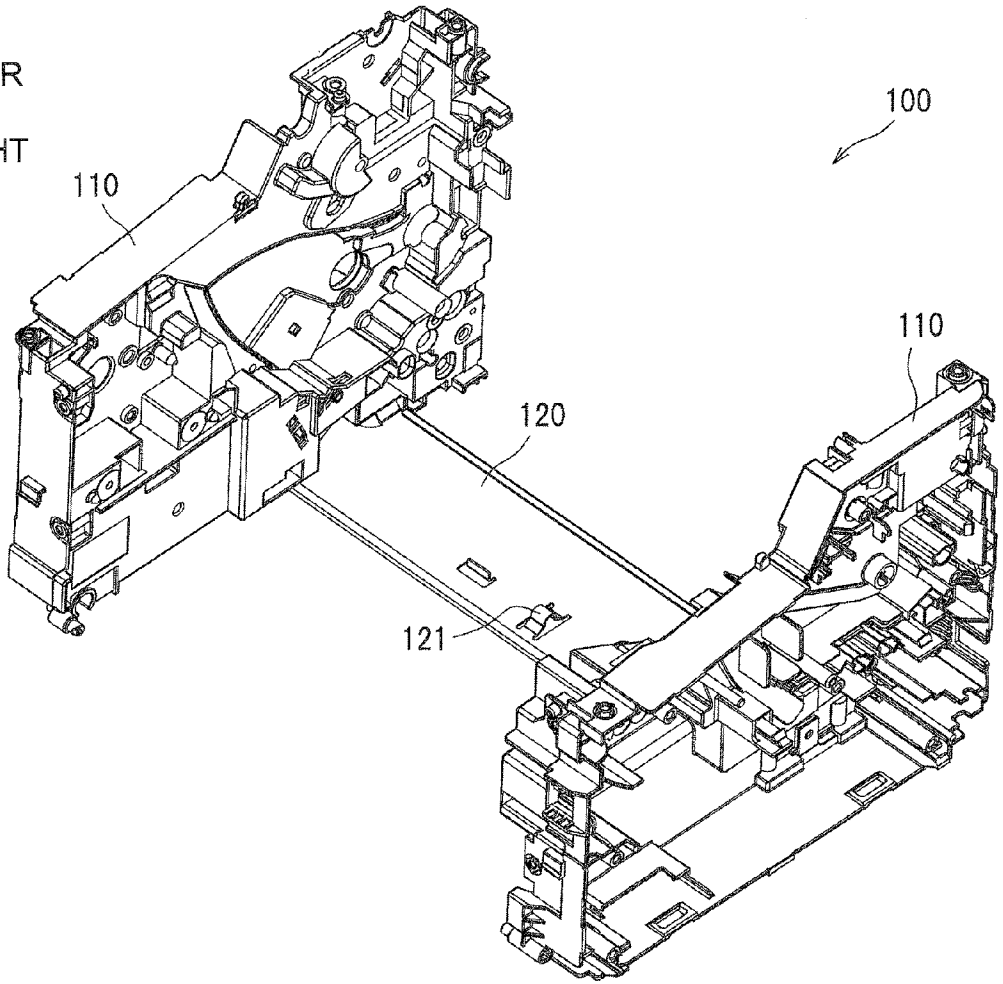
FIG. 2 is a perspective view illustrating a pair of side frames and a bridging member.

As shown in FIG. 2, the casing 100 includes a pair of side frames 110 and a bridging member 120.

The pair of side frames 110 is disposed facing each other such that the image forming portion 4 is sandwiched therebetween in the left-right direction. A bottom surface of each of the side frames 110 has two legs 111 protruding downward and located at the front and rear portions of the bottom surface respectively (see FIG. 4).

Returning to FIGS. 2 and 3, the bridging member 120 is a flat plate-like member m of sheet metal. The bridging member 120 is fixed to the side frames 110 such that it connects the bottom surfaces of the side frames 110. More specifically, the bridging member 120 connects some portions of rear end portions of the side frames 110. Specifically, the bridging member 120 has a length smaller than that of the side frames 110 in the front-rear direction, and constitutes a rear end portion of the bottom surface of the main body 2 (see FIG. 4). A rear end portion of the bridging member 120 is located frontward of the rear end portions of the side frames 110. A front end portion of the bridging member 120 is located near a central portion of the side frames 110 in the front-rear direction.

As shown in FIGS. 6A and 6B, the bridging member 120 has holes 120A, 120B, and 120C formed therethrough vertically on the left side. The holes 120A and 120B are provided side by side in the rear end portion of the bridging member 120, and the hole 120C is disposed in the front end portion of the bridging member 120.

The bridging member 120 has holes 120D, 120E, and 120F formed therethrough vertically on the right side. The hole 120D is disposed in the rear end portion of the bridging member 120, and the hole 120F is disposed in the front end portion of the bridging member 120. The hole 120E is disposed closer to the hole 120F than the hole 120D between the hole 120D and the hole 120F.

Two screws, not shown, pass through the respective holes 120A and 120C and are engaged in screw holes, not shown, provided in the left side frame 110 such that the left end portion of the bridging member 120 is fixed to the left side frame 110. Two screws, not shown, pass through the respective holes 120D and 120F and are engaged in screw holes, not shown, provided in the right side frame 110 such that the right end portion of the bridging member 120 is fixed to the right side frame 110.

The holes 120B and 120E are used for positioning. The hole 120B receives an unnumbered boss of the left side frame 110. The hole 120B is a circular hole having a size substantially equal to that of the boss to be inserted therein. The hole 120E receives an unnumbered boss of the right side frame 110. The hole 120E is a long hole extending toward a center of the hole 120B, and is intended to engage a boss to be inserted therein and prevent the bridging member 120 from rotating about the boss inserted into the hole 120B.

The bridging member 120 includes support portions 121 for supporting pivot shafts 241 of a lifting member 240. The support portions 121 are disposed in a substantially central portion and a left end portion in the left-right direction (see FIG. 6A). The support portions 121 are formed by cutting and raising a part of the bridging member 120.

Figure 3:
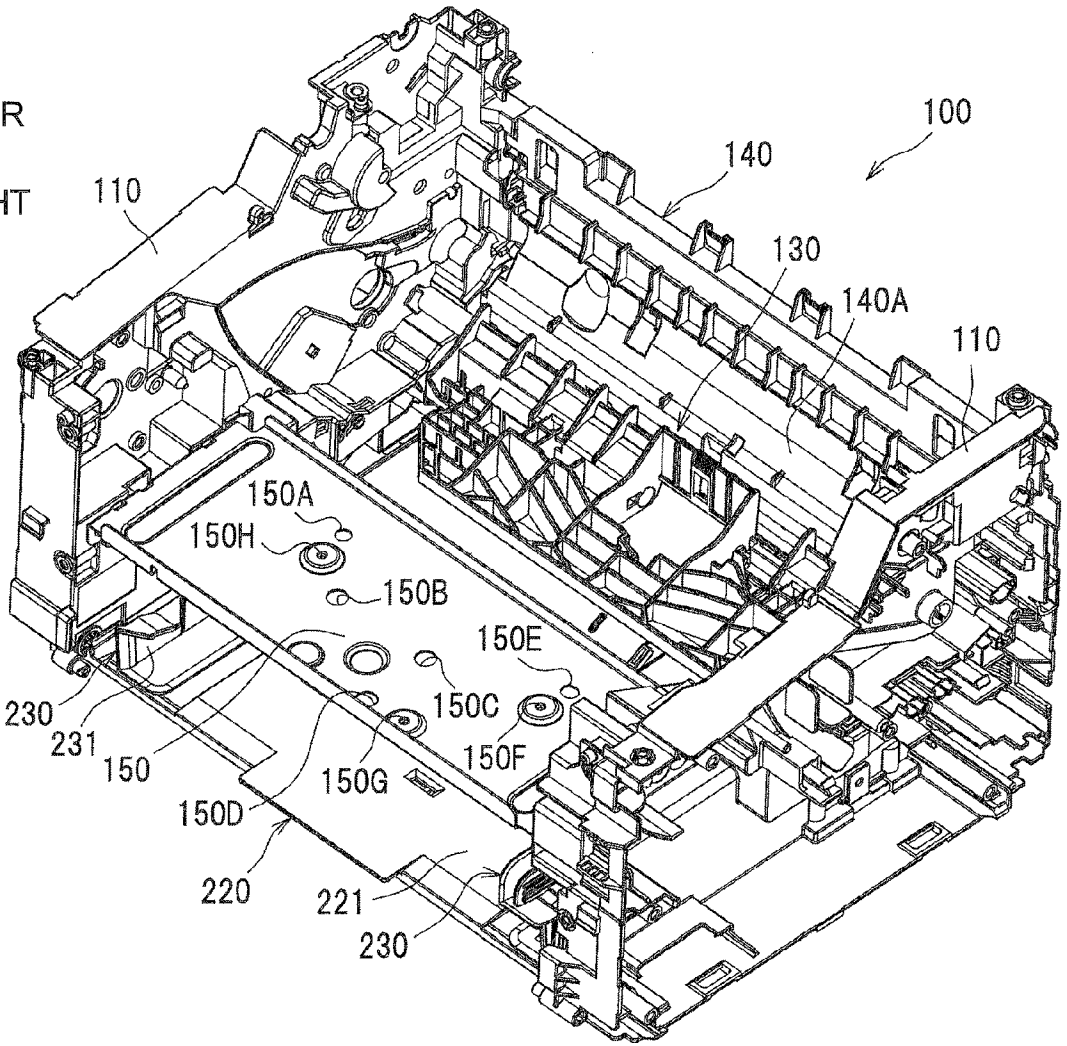
FIG. 3 is a perspective view illustrating a main body and a sheet receiving plate.

As shown in FIG. 3, the casing 100 further includes a holding frame 130, a rear chute 140, and a scanner unit holding member 150, which are disposed above the bridging member 120.

The holding frame 130 is a member that rotatably supports the feed roller 210 which is omitted from FIG. 3. The holding frame 130 is disposed in an upper portion of the bridging member 120 and fixed to the pair of side frames 110 such that it connects the pair of side frames 110.

The rear chute 140 is fixed to the pair of side frames 110 such that it connects the rear end portions of the side frames 110. The rear chute 140 is disposed extending from lower portions of the rear ends of the side frames 110 to upper portions thereof. The rear chute 140 has a guide surface 140A on its inner surface. The guide surface 140A is for guiding a sheet P to be supplied from the feeder portion 3 by the feed roller 210 toward the image forming unit 4.

The scanner unit holding member 150 is configured to hold the scanner unit 5. The scanner unit holding member 150 is made of sheet metal, and configured to fix the scanner unit 5 on an upper surface thereof. The scanner unit holding member 150 is disposed to connect some of front end portions of the side frames 110 or the other end portion. Specifically, the scanner unit holding member 150 is fixed to the side frames 110 above the front portion of the sheet receiving plate 220. More specifically, the front end portion of the scanner unit holding member 150 is located slightly behind the front end portions of the side frames 110, and the rear end portion of the scanner unit holding member 150 is located near a central portion of each of the side frames 110 in the front-rear direction.

As shown in FIG. 3, the scanner unit holding member 150 has holes 150A, 150B, 150C, 150D, 150E, 150F, 150G, and 150H which are formed therethrough vertically. The holes 150A and 150E are used for positioning, and receive respective unnumbered bosses of the scanner unit 5. The hole 150A is disposed at a position which is slightly left from a central portion of the scanner unit holding member 150 and near the rear end portion of the scanner unit holding member 150. The hole 150A is a circular hole having a size substantially equal to that of a boss to be inserted therein. The hole 150E is a long hole extending toward a center of the hole 150A and receives a boss therein to prevent the scanner unit 5 from rotating about the boss inserted into the hole 150A.

The holes 150B, 150C, and 150D are disposed on a front side of a central portion of the scanner unit holding member 150. The holes 150B, 150C, and 150D receive respective bosses (not shown) of the scanner unit 5. The holes 150B, 150C, and 150D have a size slightly greater than that of the bosses of the scanner unit 5 such as to be capable of receiving the bosses loosely.

The hole 150H is disposed in front of the positioning hole 150A. The hole 150F is disposed in front of the positioning hole 150E. The hole 150G is disposed at a position which is slightly right from the central portion of the scanner unit holding member 150 and near the front end portion of the scanner unit holding member 150. Three screws, not shown, pass through the respective holes 150F, 150G and 150H, and are engaged in screw holes, not shown, in the scanner unit 5 such that the scanner unit 5 is fixed to the scanner unit holding member 150.

The following will describe the detailed structure of the feeder portion 3.

Figure 5:
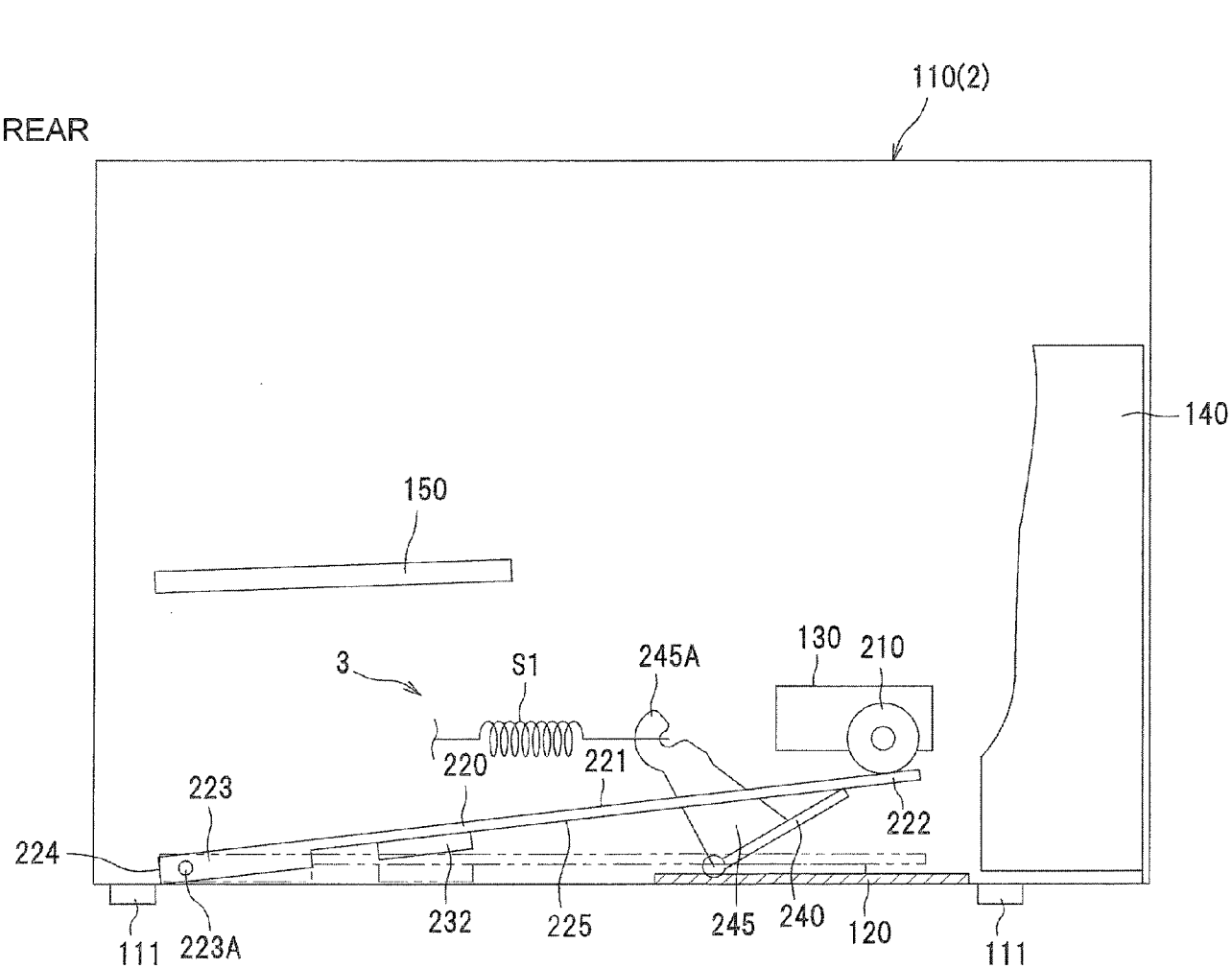
FIG. 5 schematically illustrates the main body and a feeder portion.
Figure 5:
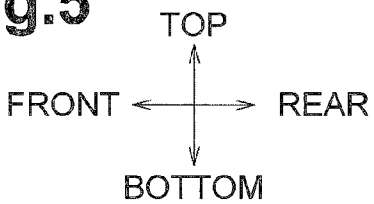
Figure 8A:
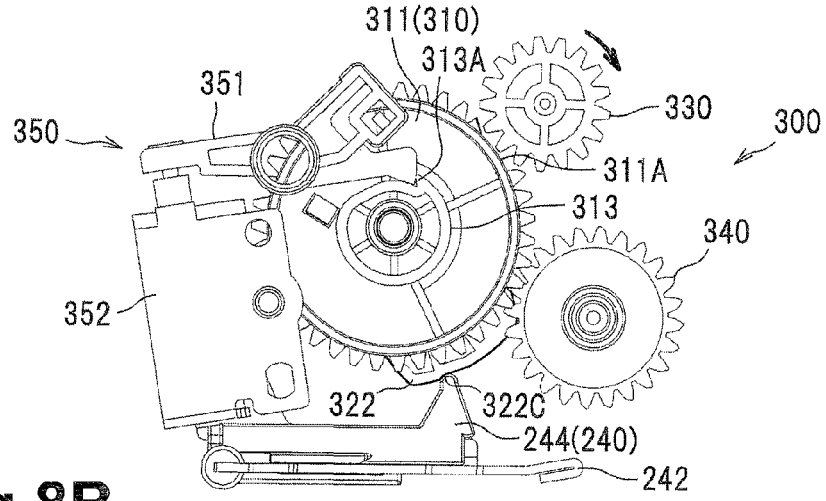
FIGS. 8A and 8B illustrate the feeder portion during standby.

The feeder portion 3 includes the feed roller 210 and the sheet receiving plate 220, which are shown in FIG. 5, a pair of guide members 230, which is shown in FIGS. 1 and 3, a lifting member 240, a tension spring S1, and a drive mechanism 300 shown in FIG. 8A.

The feed roller 210 is rotatably supported by the holding frame 130 at the rear end portion of the main body 2. The feed roller 210 is configured to receive a driving force from a third gear 340 (see FIG. 8A) to rotate.

The sheet receiving plate 220 is a plate-like member on which a sheet P is to be placed and is configured to raise the sheet P received on an upper surface 221, which is a sheet receiving surface, toward the feed roller 210. Specifically, the sheet receiving plate 220 is disposed such that its rear end portion 222, as an example of one end portion, is located above the bridging member 120, and a rotation shaft 223A located in the vicinity of a front end portion 223, as an example of the other end portion, is rotatably supported by the side frames 110 (of the main body 2). With this structure, the sheet receiving plate 220 is movable between a nearby position, indicated by a solid line in FIG. 5, where the rear end portion 222 moves toward the feed roller 210 and a remote position, indicated by a double dotted line in FIG. 5, where the rear end portion 222 moves away from the feed roller 210.

The front end portion 223 of the sheet receiving portion 220 is located in the vicinity of the front end portions of the side frames 110, and the rear end portion 222 of the sheet receiving portion 220 is located in the vicinity of the rear end portions of the side frames 110, and more specifically in a position facing the feed roller 210.

The sheet receiving plate 220 is disposed such that, when the rear end portion 222 of the sheet receiving plate 220 is located at the highest position or the sheet receiving plate 220 is in the nearby position, an edge 224 of the front end portion 223 overlaps the bridging member 120 as viewed along a surface of the bridging member 120. More specifically, the sheet receiving plate 220 is disposed such that the edge 224 of the front end portion 223 of the sheet receiving plate 220 and the bridging member 120 overlap each other in the horizontal direction.

As shown in FIGS. 1 and 3, the guide members 230 are disposed in the left and right end portions of the sheet receiving plate 220 respectively. The guide members 230 include guide plates 231 and rack gear portions 232 (FIG. 4).

The guide plates 231 extend upward from the left and right ends of the sheet receiving plate 220 and are elongated in the front-rear direction. The guide plates 231 are configured to adjust the position of a sheet P, in a width direction, received on the upper surface 221 of the sheet receiving plate 220, by contacting both ends of the sheet P in the width direction.

Figure 4:
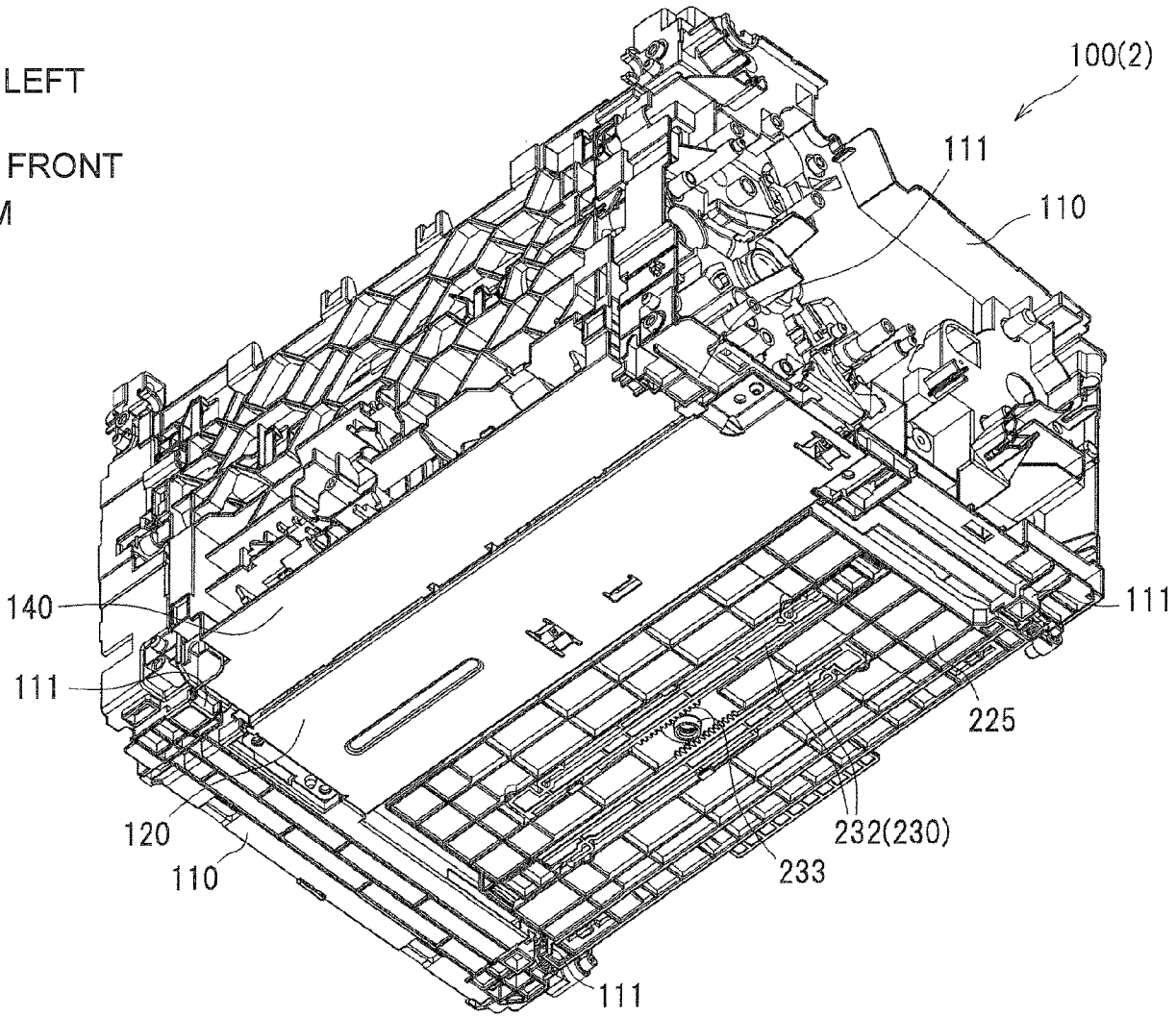
FIG. 4 is a perspective view of the main body and the sheet receiving plate as viewed from below.

The rack gear portions 232 are routed from the lower portions of the guide plates 231, through holes (shown without numerals) formed in the sheet receiving plate 220, to a lower surface 225 of the sheet receiving plate 220 opposite to the upper surface 221, and extend inward in the left-right direction from the left and right ends as shown in FIG. 4. The rack gear portions 232 each have gear teeth formed in a portion where the rack gear portions 232 face each other, and engage a pinion gear 233 located between the rack gear portions 232.

With this structure, as one of the guide members 230 is moved in the width direction in accordance with the size of a sheet P, the other one of the guide members 230 is moved in the width direction in an interlocked manner.

The rack gear portions 232 and the pinion gear 233 are disposed in positions where they do not overlap the bridging member 120 vertically or positions where they overlap the bridging member 120 horizontally.

As shown in FIG. 5, the lifting member 240 is disposed under the rear end portion 222 of the sheet receiving plate 220 or on an opposite side of the upper surface 221. The lifting member 240 is configured to move between a first position (indicated by a solid line) where the sheet receiving plate 220 is lifted and located in the nearby position and a second position (indicated by a double dotted line) where the sheet receiving plate 220 is located in the remote position.

Specifically, as shown in FIGS. 6A and 6B, the lifting member 240 is rotatably supported by the bridging member 120. The lifting member 240 is made of sheet metal and extends from the left end portion of the bridging member 120 to substantially a central portion thereof.

The lifting member 240 includes pivot shafts 241 disposed at two positions, at the left and right of the front end portion. As shown in FIG. 6C, the pivot shafts 241 have a circular cross section. The pivot shafts 241 are rotatably supported by the respective support portions 121 of the bridging member 120. With this structure, the lifting member 240 is configured to pivot such that the rear end portion thereof moves vertically, as shown in FIGS. 6A and 6B.

The pivot shafts 241 are made of resin. With this structure, the pivot shafts 241 are constructed at low costs.

The left end portion of the lifting member 240 includes a second cam 322 of the drive mechanism 300 and an operation portion 243 integrally formed with the left pivot shaft 241. The operation portion 243 extends along a left edge of the lifting member 240 in the front-rear direction, and is disposed outside the sheet receiving plate 220 in the width direction of a sheet P or in the left-right direction.

The operation portion 243 includes, at a rear end portion thereof, a contact portion 244 having a shape of substantially a triangle that protrudes upward as viewed from a side. The operation portion 243 is made of resin. The operation portion 243 includes, at a front end thereof, an arm portion 245 extending upward, and the arm portion 245 includes, at a distal end thereof, a hook portion 245A. The resin of the operation portion 243 possesses sufficient strength to withstand a pressing force applied from the second cam 322.

The lifting member 240 includes, at the rear end of the right end portion thereof, two lift portions 242 spaced apart from each other in the left-right direction. When the lifting member 240 is in the second position, the lift portions 242 extend diagonally upward to the rear from the connecting portion 240A of the lifting member 240. As shown in FIG. 10C, when the lifting member 240 moves from the second position to the first position, the lift portions 242 contact a lower surface 225 of the sheet receiving plate 220.

Figure 8B:
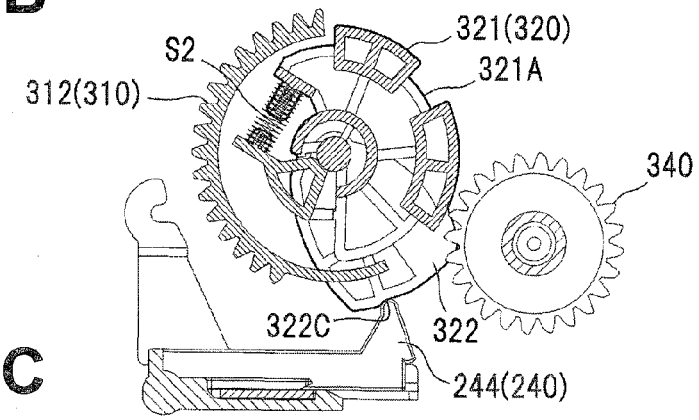
Figure 8C:
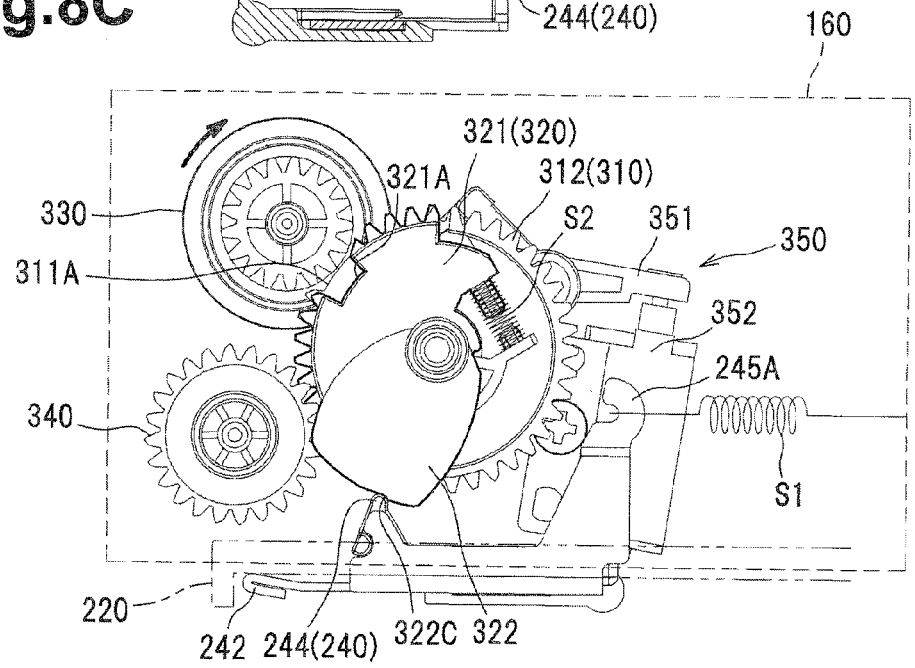
FIG. 8C illustrates the feeder portion viewed from an opposite side thereof shown in FIG. 8A.

As shown in FIG. 8C, the tension spring S1 is engaged at the hook portion 245A of the lifting member 240 at one end portion, and supported by a gear support member 160 at the other end portion. The tension spring S1 is elongated in the front-rear direction along the upper surface 221 of the sheet receiving plate 220 located in the remote position. This structure can obviate the need to increase the physical size of the main body 2 vertically compared with a structure where the tension spring S1 is disposed such as to extend along the vertical direction where the sheet receiving plate 220 and the feed roller 210 face each other.

The tension spring S1 pulls the hook portion 245A frontward. In other words, the tension spring S1 urges the lifting member 240 from the second position shown in FIG. 6A toward the first position shown in FIG. 6B.

The drive mechanism 300 is a mechanism for controlling movement of the lifting member 240 between the first position and the second position and rotation of the feed roller 210. Specifically, the drive mechanism 300 is configured to, when the feed roller 210 feeds a sheet P, move the lifting member 240 from the second position to the first position, rotate the feed roller 210, and to return the lifting member 240 to the second position after the feed roller 210 is rotated.

The drive mechanism 300 includes a first gear 310 shown in FIG. 7A, a second gear 320 shown in FIG. 7C, and a drive gear 330, a third gear 340 and a latch mechanism 350, which are shown in FIG. 8A.

The first gear 310, the second gear 320, the drive gear 330, and the third gear 340 are an example of a plurality of gears that transmit a driving force from a driving source M, disposed within the main body 2 shown in FIG. 1, to the second cam 322, are disposed outside the sheet receiving plate 220 in the left-right direction and rotatably supported by the gear support member 160 disposed within the main body 2.

The gear supporting member 160 is made of a material having high stiffness to hold the gears 310, 320, 330, and 340 and the tension spring S1 with stability.

As shown in FIGS. 7A and 7B, the first gear 310 includes a drive gear portion 311, a transmission gear portion 312, a first cam 313, a first spring support portion 314, and first stopper portions 316.

The drive gear portion 311 is a circular gear having gear teeth on a peripheral surface thereof except for a missing teeth portion 311A. The drive gear portion 311 is configured to rotate by engagement of the drive gear 330. During standby where no sheets are supplied, or in conditions shown in FIGS. 8A to 8C, the missing teeth portion 311A is disposed in a position facing the drive gear 330.

The transmission gear portion 312 is substantially a semi-circular gear having gear teeth on about two-thirds of a peripheral surface thereof. The transmission gear portion 312 is configured to rotate in engagement with the third gear 340 to cause the third gear 340 to rotate. The transmission gear portion 312 is disposed such that the gear teeth thereof do not face the third gear 340 during standby and faces the third gear 340 after the lifting member 240 is located in the first position. The gear teeth of the transmission gear portion 312 are provided such as to rotate the third gear 340 only by the amount required for the feed roller 210 to pick up a sheet P.

The first cam 313 is of substantially a tubular shape, and has an engaging pawl 313A radially protruding from a peripheral surface thereof. The engaging pawl 313A is intended to prevent the first gear 310 from rotating during standby by engagement of a distal end of a latch arm 351.

The drive gear portion 311, the transmission gear portion 312, and the first cam 313 are integrally formed with each other such as to rotate coaxially. Specifically, the first cam 313, the drive gear portion 311, and the transmission gear portion 312 are arranged in this order in an axial direction such that a center of a through hole 315 formed in the first gear 310 is a center of rotation.

The first spring support portion 314 is disposed on a side of the first gear 310 opposite the first cam 313. The first spring support portion 314 has a first support surface 314A extending radially from the through hole 315 and a first support protrusion 314B protruding from the first support surface 314A.

The first stopper portions 316 are walls radially extending from the through hole 315, and located at two positions shifted circumferentially.

The second gear 320 includes a gear portion 321, a second cam 322 as an example of a cam, a second spring support portion 323, and second stopper portions 325.

The gear portion 321 is substantially semi-circularly shaped, and has gear teeth on a circumferential surface thereof. Specifically, the circumferential surface of the gear portion 321 has a missing gear portion 321A having a circumferential length equal to that of the missing teeth portion 311A of the drive gear portion 311 of the first gear 310, and gear teeth disposed in such a manner as to sandwich the missing gear portion 321A. The gear teeth of the gear portion 321 are provided such that they are in phase with those of the drive gear portion 311 of the first gear 310. The gear portion 321 is disposed such that the missing teeth portion 321A overlaps the missing teeth portion 311A of the first gear 310 during standby.

The second cam 322 is a cam that rotates coaxially with a rotation axis of the gear portion 321, and is disposed in a position where the second cam 322 is capable of contacting the contact portion 244 of the lifting member 240 in the axial direction. The second cam 322 has a circumferential surface comprised of a first surface 322A, a second surface 322B, and a recessed portion 322C.

Specifically, the first surface 322A is disposed in a position away from a center of rotation of the second cam 322 such as to position the lifting member 240 in the second position against an urging force of the tension spring S1 when the first surface 322A faces the contact portion 244 of the lifting member 240.

The second surface 322B is a surface having a shorter distance from the center of rotation than that of the first surface 322A, and is configured to allow the lifting member 240 to move from the second position to the first position by the urging force of the tension spring S1 when the second surface 322B faces the contact portion 244 of the lifting member 240.

The recessed portion 322C is provided on the first surface 322A. The recessed portion 322C is shaped such that, when the recessed portion 322C faces the contact portion 244 of the lifting member 240, a force with which the contacting portion 244 presses the recessed portion 322C (a cam surface) is directed toward the center of rotation of the second cam 322.

The second cam 322 structured as described above is disposed such that the recessed portion 322C faces the contact portion 244 of the lifting member 240 during standby.

The gear portion 321 and the second cam 322 are integrally formed such that they rotate together about a shaft portion 324 of the second gear 320 as a rotation shaft.

The second spring support portion 323 is disposed on an end surface of the gear portion 321 extending radially. The second spring support portion 323 has a second support surface 323A extending radially and a second support protrusion 323B protruding from the second support surface 323A.

The second stopper portions 325 are protrusions protruding in a circumferential direction from walls extending radially from the shaft portion 324. The second stopper portions 325 are located at two positions shifted circumferentially in such a manner as to sandwich the first stopper portions 316 of the first gear 310 when the second gear 320 is attached to the first gear 310.

The first gear 310 and the second gear 320 structured as described above are combined into one component by inserting the shaft portion 324 of the second gear 320 into the through hole 315 of the first gear 310, and the shaft portion 324 is rotatably supported by the gear support member 160. One of the first gear 310 and the second gear 320 is rotatable relative to the other one. One of the first gear 310 and the second gear 320 is prevented from rotating relative to the other one by engagement of the first stopper portions 316 of the first gear 310 with the second stopper portions 325 of the second gear 320. When the first stopper portions 316 engage the second stopper portions 320, the gear teeth of the drive gear portion 311 of the first gear 310 are in phase with the gear teeth of the gear portion 321 of the second gear 320.

In a state where the second gear 320 is assembled to the first gear 310, an end of the second support protrusion 323B faces an end of the first support protrusion 314B, and a compression spring S2 is interposed between the first spring support portion 314 and the second spring stopper portion 323.

As shown in FIG. 8A, the drive gear 330 is a gear that rotates upon a driving force inputted from a drive source M (FIG. 1) disposed within the main body 2. The drive gear 330 is disposed in such a position that the drive gear 330 is engageable with the drive gear portion 311 of the first gear 310 and the second gear 320 and does not engage the transmission gear portion 312 of the first gear 310.

The third gear 340 is a gear that transmits a rotational driving force to the feed roller 210. The third gear 340 is disposed in such a position that the third gear 340 is engageable with the transmission gear portion 312 of the first gear 310 and does not engage the drive gear portion 311 of the first gear 310 and the second gear 320.

The latch mechanism 350 includes the latch arm 351 that is pivotable and a solenoid 352 that presses and pulls a proximal end portion of the latch arm 351. The latch arm 351 is disposed in a position where a distal end thereof contacts the circumferential surface of the first cam 313 of the first gear 310.

The following will describe the operation of the feeder portion 3 structured as described above.

During standby shown in FIGS. 8A to 8C, the recessed portion 322C on the first surface 322A of the second cam 322 faces the contact portion 244 of the lifting member 240. Thus, the second cam 322 holds the lifting member 240 in the second position against the urging force of the tension spring S1.

During standby, the second gear 320 is prevented from rotating by engagement of the recessed portion 322C of the second cam 322 with the contact portion 244 of the lifting member 240. The first gear 310 is prevented from rotating in such a position that the compression spring S2 is compressed by engagement of the latch arm 351 with the engaging pawl 313A.

Figure 9A:
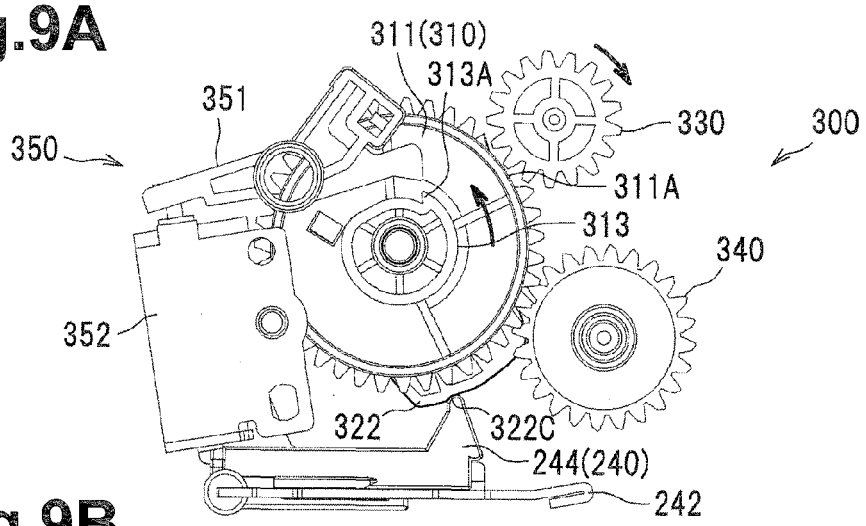
FIGS. 9A and 9B illustrate the feeder portion during operation of a solenoid.
Figure 9B:
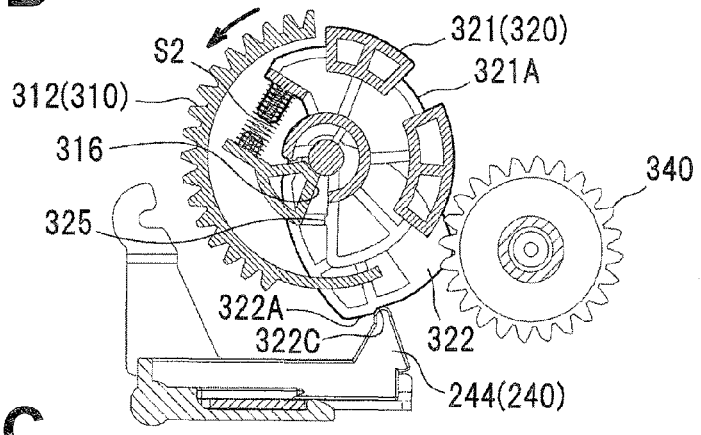
Figure 9C:
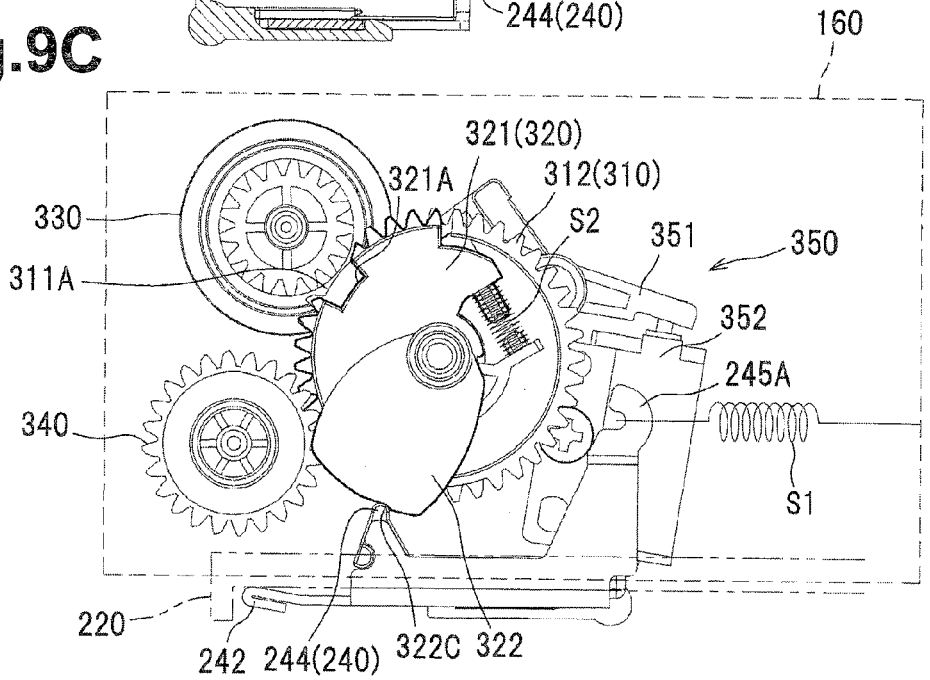
FIG. 9C illustrates the feeder portion viewed from an opposite side thereof shown in FIG. 9A.

As shown in FIG. 9A, when it comes time to supply a sheet P, the solenoid 352 is actuated from a standby status, and the latch arm 351 is disengaged from the engaging pawl 313A of the first gear 310. Then, as shown in FIGS. 9A to 9C, the first gear 310 is caused to rotate counterclockwise in FIG. 9A by the urging force of the compression spring S2, and the gear teeth of the drive gear portion 311 of the first gear 310 engage the drive gear 330 rotating. Thus, the first gear 310 is driven by the drive gear 330 and starts to rotate.

Figure 10A:
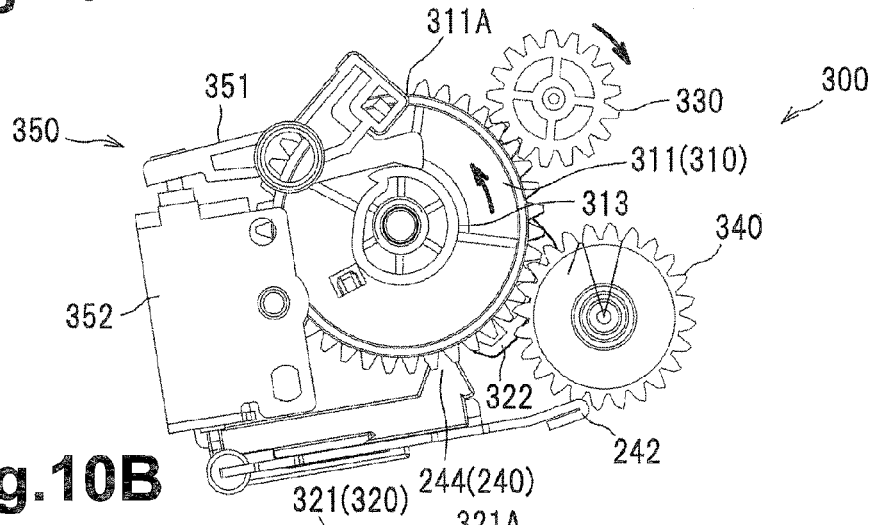
FIGS. 10A and 10B illustrate the feeder portion when the sheet receiving plate starts to move upward.
Figure 10B:
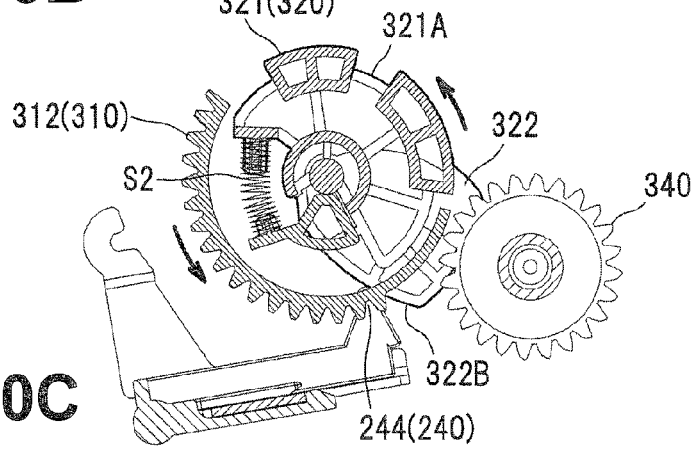
Figure 10C:
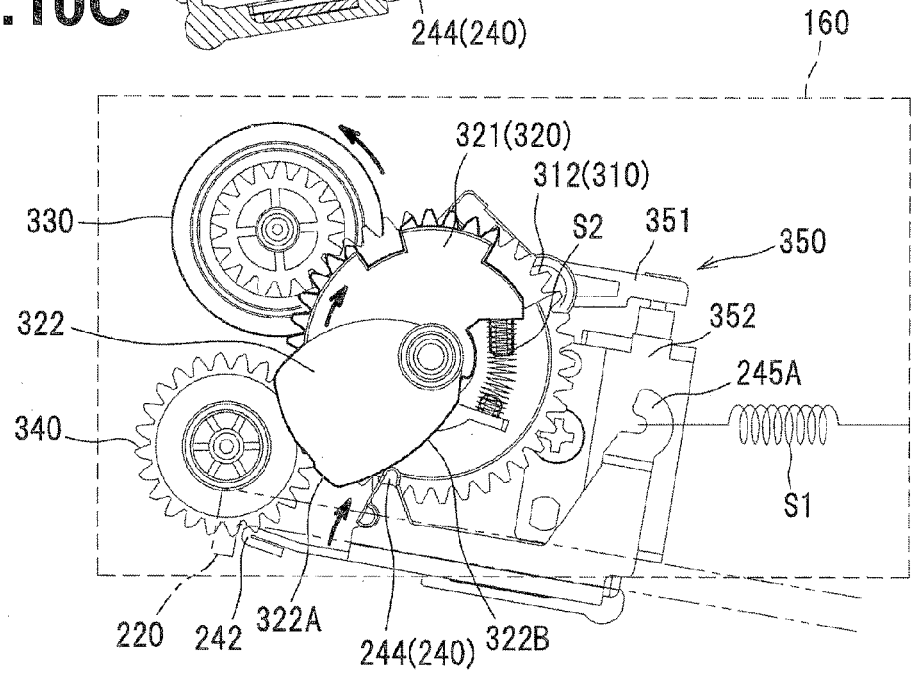
FIG. 10C illustrates the feeder portion viewed from an opposite side thereof shown in FIG. 10A.

As shown in FIGS. 10A to 10C, when the drive gear portion 311 of the first gear 310 rotates, the first stopper portion 316 disposed on a downstream side in a rotation direction of the first gear 310 collides with the second stopper portion 325 of the second gear 320 facing the first gear 310 and presses the second gear 320. Thus, the second gear 320 starts to rotate. When the second gear 320 rotates, a surface of the second cam 322 facing the contact portion 244 of the lifting member 240 changes from the first surface 322A to the second surface 322B. Thus, the lifting member 240 starts to move upward from the second position toward the first position along the second surface 322B of the second cam 322 by the urging force of the tension spring S1. When the lifting member 240 moves from the second position to the first position, the lift portions 242 of the lifting member 240 lift the sheet receiving plate 220 from below. Thus, the rear end portion 222 of the sheet receiving plate 220 starts to move from the remote position to the nearby position.

Figure 11A:
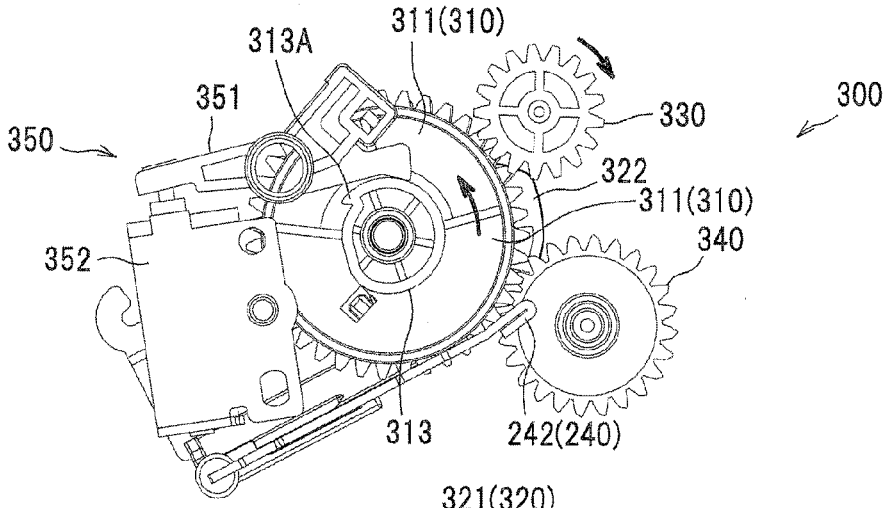
FIGS. 11A and 11B illustrate the feeder portion when a feed roller starts to rotate.
Figure 11B:
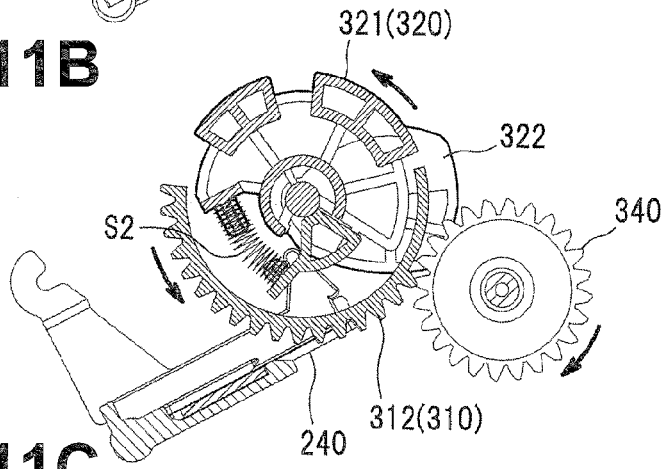
Figure 11C:
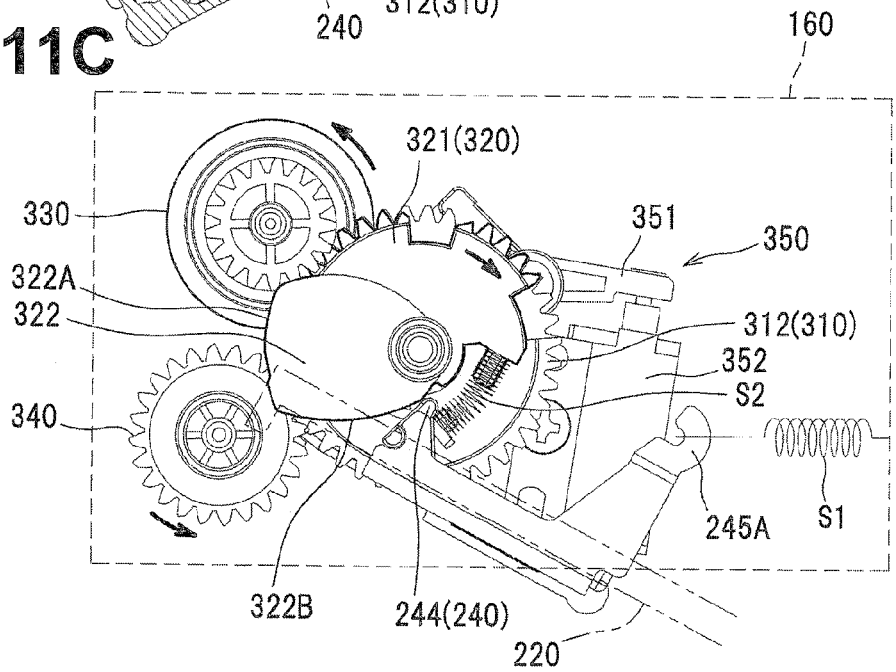
FIG. 11C illustrates the feeder portion viewed from an opposite side thereof shown in FIG. 11A.

When the first gear 310 and the second gear 320 rotate, as shown in FIGS. 11A to 11C, the sheet receiving plate 220 is located in the nearby position and the gear teeth of the transmission gear portion 312 of the first gear 310 engage the third gear 340. As the third gear 340 starts to rotate, the feed roller 210 also rotates. Thus, the sheet P received on the sheet receiving plate 220 is supplied by the feed roller 210.

After the sheet P is supplied, the gear teeth of the transmission gear portion 312 of the first gear 310 are disengaged from the third gear 340, and the feed roller 210 stops.

When the first gear 310 and the second gear 320 further rotate, the surface of the second cam 322 facing the contact portion 244 of the lifting member 240 changes from the second surface 322B to the first surface 322A, and thus the lifting member 240 is pressed downward from the first position to the second position. This also causes the sheet receiving plate 220 to move from the nearby position to the remote position.

Then, as shown in FIG. 8A, the distal end of the latch arm 351 engages the engaging pawl 313A of the first gear 310, and the first gear 310 stops rotating. The recessed portion 322C of the second cam 322 engages the contact portion 244 of the lifting member 240, and the second gear 320 stops. In other words, when the feed roller 210 feeds a sheet P, the second cam 322 makes one rotation, during which the second cam 322 causes the lifting member 240 to move from the second position to the first position and then to the second position again.

According to the embodiment, the following effects can be obtained.

As the second cam 322 for moving the sheet receiving plate 220 vertically contacts not the sheet receiving plate 220 but the lifting member 240, the sheet receiving plate 220 does not need high stiffness.

The sheet receiving plate 220 is used for receiving a sheet P, and requires a large area enough to receive the sheet P. In order to obtain high stiffness, the sheet receiving plate 220 requiring a large area needs to be made of sheet metal or resin having high strength, which may lead to increased manufacturing cost. However, the lifting member 240 configured to lift the sheet receiving plate 220 does not need such a large area as the sheet receiving plate 220. As the second cam 322 is configured to contact the lifting member 240 in this embodiment, the manufacturing cost can be reduced compared with a case to make the sheet receiving plate 220 with a material having high stiffness.

The second cam 322 is configured to make one rotation in time with supplying of a sheet P. The sheet P can be supplied with a simple structure.

The recessed portion 322C is disposed on the circumferential surface of the second cam 322. When the contact portion 244 of the lifting member 240 engages in the recessed portion 322C, the lifting member 240 is held in the second position. Thus, during standby, the lifting member 240 can be reliably positioned in the second position.

The contact portion 244 of the lifting member 240 and the second cam 322 are disposed outside the sheet receiving plate 220 in the left-right direction. Compared with a case where they are disposed so as to overlap the sheet receiving plate 220, the need to increase the physical size of the main body 2 can be obviated.

As the contact portion 244 of the lifting member 240 is made of resin, it can be slid along the circumferential surface of the second cam 322. The resin for the contact portion 244 possesses sufficient strength to withstand a pressing force applied from the second cam 322, and thus will not be deformed due to the pressing force applied from the second cam 322.

The above embodiment shows, but is not limited to, that the lifting member 240 is made of sheet metal and resin. The lifting member 240 may be made of resin having high strength in its entirety. Even in this case, the lifting member 240 can be made smaller in space and more lower in cost than the sheet receiving plate 220.

The above embodiment shows, but is not limited to, that the second cam 322, as an example of a cam, has the first surface 322A and the second surface 322B on its circumferential surface. A cam configured to rotate may include more than one first surface and more than one second surface on its circumferential surface such that more than one sheet can be fed during one rotation of the cam.

The above embodiment shows, but is not limited to, that the second cam 322 is configured to rotate. A linear cam may be used.

The above embodiment shows, but is not limited to, the tension spring S1 as an urging member. A plate spring or a torsion spring may be applied.

The sheets P, as an example of recording sheets, may include thick paper, postcards, thin paper, and transparencies.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. A sheet supplying apparatus comprising:

a feed roller configured to feed a recording sheet;

a sheet receiving plate configured to receive the recording sheet on a sheet receiving surface and pivot between a nearby position where the sheet receiving plate is disposed near the feed roller and a remote position where the sheet receiving plate is disposed remote from the feed roller;

a lifting member disposed on a side of the sheet receiving plate opposite to the sheet receiving surface and configured to pivot between a first position where the sheet receiving plate is in the nearby position and a second position where the sheet receiving plate is in the remote position;

an urging member configured to urge the lifting member from the second position toward the first position; and a cam configured to contact the lifting member and, when the feed roller feeds a recording sheet, cause the lifting member to move from the second position to the first position then back to the second position again, wherein the lifting member includes a contact portion configured to contact the cam, wherein the cam has a first surface and a second surface, and the cam is configured to, when the first surface contacts the contact portion of the lifting member, position the lifting member in the second position against an urging force of the urging member, and configured to, when the second surface contacts the contact portion of the lifting member, allow the lifting member to move from the second position to the first position, wherein the first surface of the cam includes a recessed portion, and wherein, when the contact portion of the lifting member engages in the recessed portion, the lifting member is in the second position.

2. The sheet supplying apparatus according to claim 1, wherein the cam is configured to rotate and has the first surface and the second surface on a circumferential surface thereof, a distance from a rotation center of the cam to the first surface is longer than a distance from the rotation center of the cam to the second surface, and the cam is configured to, when the feed roller feeds a sheet, make one rotation.

3. The sheet supplying apparatus according to claim 1, wherein the contact portion of the lifting member and the cam are disposed outside the sheet receiving plate in a width direction of the recording sheet.

4. The sheet supplying apparatus according to claim 3, wherein the urging member extends along the sheet receiving surface of the sheet receiving plate disposed in the remote position.

5. The sheet supplying apparatus according to claim 1, wherein the lifting member is made of sheet metal and the contact portion is made of resin.

6. The sheet supplying apparatus according to claim 5, wherein the lifting member includes a lift portion at a first end portion thereof, and a pivot shaft at a second end portion thereof, the lift portion is configured to lift the sheet receiving plate when the lifting member moves from the second position to the first position, and the pivot shaft is pivotally supported and made of resin and has a circular cross section.

7. The sheet supplying apparatus according to claim 1, further comprising:

a drive source;

a plurality of gears for transmitting a driving force from the drive source to the cam; and a gear supporting member supporting the plurality of gears and the urging member.

* * * * *